US011883760B2

(12) United States Patent
Choi

(10) Patent No.: US 11,883,760 B2
(45) Date of Patent: Jan. 30, 2024

(54) FOLDABLE TOY

(71) Applicant: Shin-Kyu Choi, Seoul (KR)

(72) Inventor: Shin-Kyu Choi, Seoul (KR)

( * ) Notice: Subject to any disclaimer, the term of this patent is extended or adjusted under 35 U.S.C. 154(b) by 267 days.

(21) Appl. No.: 17/422,725

(22) PCT Filed: Jul. 15, 2019

(86) PCT No.: PCT/KR2019/008703

§ 371 (c)(1),
(2) Date: Jul. 13, 2021

(87) PCT Pub. No.: WO2020/230950

PCT Pub. Date: Nov. 19, 2020

(65) Prior Publication Data

US 2022/0080328 A1 Mar. 17, 2022

(30) Foreign Application Priority Data

May 13, 2019 (KR) ..... 10-2019-0055764

(51) Int. Cl.
*A63H 33/00* (2006.01)
*A63H 3/16* (2006.01)

(52) U.S. Cl.
CPC ..... *A63H 33/003* (2013.01); *A63H 3/16* (2013.01)

(58) Field of Classification Search
CPC ..... A63H 33/003; A63H 33/26; A63H 3/16; A63H 17/02; A63H 17/266
USPC ..... 446/465, 487
See application file for complete search history.

(56) References Cited

U.S. PATENT DOCUMENTS 2,577,102 A * 12/1951 Bolger ..... A63H 33/007 446/449
5,129,851 A * 7/1992 Villanueva ..... A63H 33/003 446/469
8,066,542 B2 11/2011 Ejima
(Continued)

FOREIGN PATENT DOCUMENTS

CN 201735174 U 2/2011
CN 106457053 A 2/2017
(Continued)

OTHER PUBLICATIONS

Extended Search Report for corresponding European Patent Application No. 19929160.0 / PCT/KR2019/008703, dated Jan. 2, 2023, 6 pages.

(Continued)

*Primary Examiner* — Joseph B Baldori
(74) *Attorney, Agent, or Firm* — Lewis Roca Rothgerber Christie LLP

(57) ABSTRACT

A foldable toy includes: a body part; a support part movably connected to the body part; at least one movable body part movably connected to at least one of the body part or the support part; and a locking part to fix the moveable body part in a first position to lock the foldable toy in a first shape in which the body part, the support part, and the movable body part are deployed. When the locking part is unlocked, the movable body part moves to a second position, and the foldable toy is folded into a second shape in which the body part, the support part, and the movable body part are stacked on one another.

10 Claims, 16 Drawing Sheets

(56) References Cited

U.S. PATENT DOCUMENTS

| | | | | |
|---|---|---|---|---|
| 8,814,629 | B2 * | 8/2014 | Johnston | A63H 17/02 446/431 |
| 9,579,583 | B2 * | 2/2017 | Sheltman | A63H 17/008 |
| 10,207,194 | B2 * | 2/2019 | Sheltman | A63H 17/26 |
| 10,307,684 | B2 * | 6/2019 | Choi | A63H 17/02 |
| 10,814,240 | B2 * | 10/2020 | Cai | A63H 33/003 |
| 11,123,653 | B2 * | 9/2021 | Choi | A63H 33/26 |
| 11,648,486 | B2 * | 5/2023 | Choi | A63H 33/26 446/129 |
| 2012/0309257 | A1 | 12/2012 | McDonald et al. | |
| 2015/0050859 | A1 | 2/2015 | Choi | |
| 2016/0045835 | A1 * | 2/2016 | Choi | A63F 1/06 446/454 |
| 2018/0133612 | A1 | 5/2018 | Choi | |
| 2018/0147502 | A1 | 5/2018 | Choi | |
| 2018/0193760 | A1 | 7/2018 | Yamada et al. | |
| 2018/0311593 | A1 | 11/2018 | Choi | |

FOREIGN PATENT DOCUMENTS

| | | | |
|---|---|---|---|
| CN | 107645965 | A | 1/2018 |
| CN | 108290076 | A | 7/2018 |
| JP | 62-111092 | U | 7/1987 |
| KR | 10-2013-0097615 | A | 9/2013 |
| KR | 20130097615 | A | 9/2013 |
| KR | 101375110 | B1 | 3/2014 |
| KR | 10-2015-0078090 | A | 7/2015 |
| KR | 20150078090 | A | 7/2015 |
| KR | 10-2018-0001012 | A | 1/2018 |
| WO | WO 2014119220 | A1 | 8/2014 |

OTHER PUBLICATIONS

International Search Report for corresponding International Application No. PCT/KR2019/008703, dated Feb. 6, 2020, 4pp.

Chinese Office Action dated Apr. 27, 2022 in Chinese Patent Application No. 201980077688.4.

International Preliminary Report on Patentability, for corresponding PCT Application No. PCT/KR2019/008703, dated Nov. 16, 2021 (1 page), including Written Opinion dated Feb. 6, 2020 (English Translation) (5 pages).

* cited by examiner

[FIG. 1]
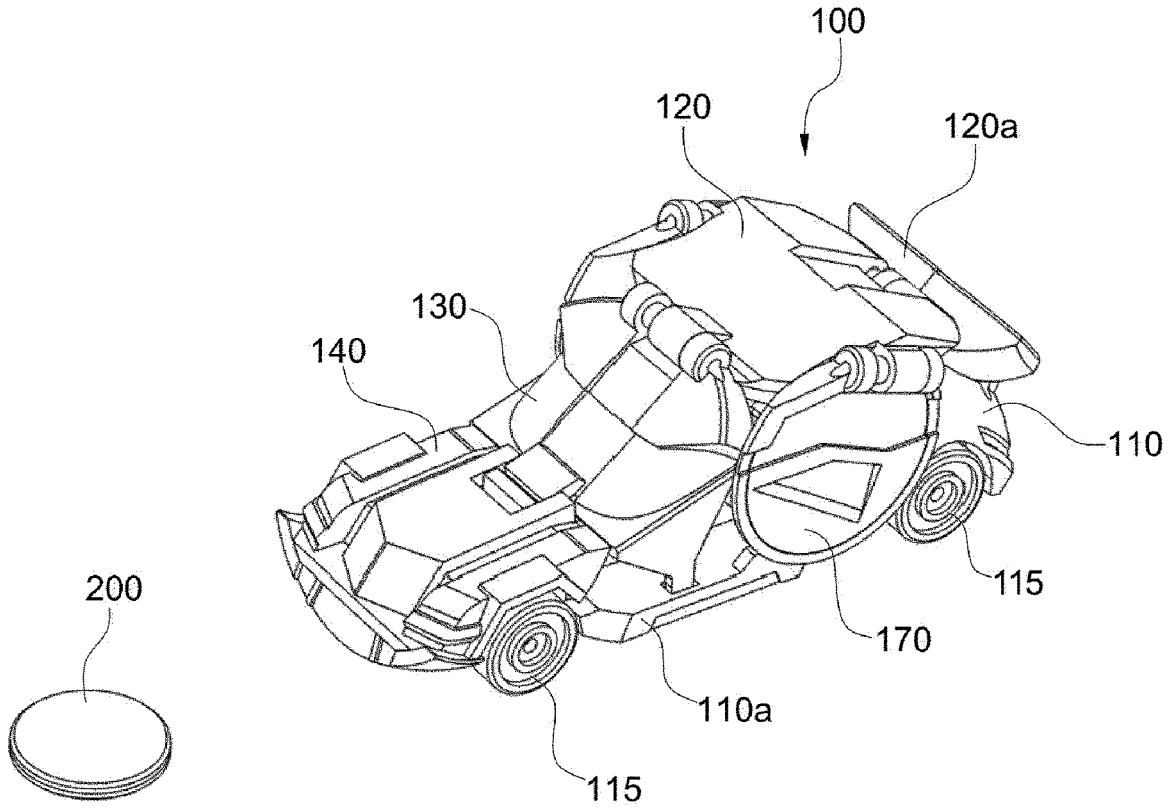

[FIG. 2]
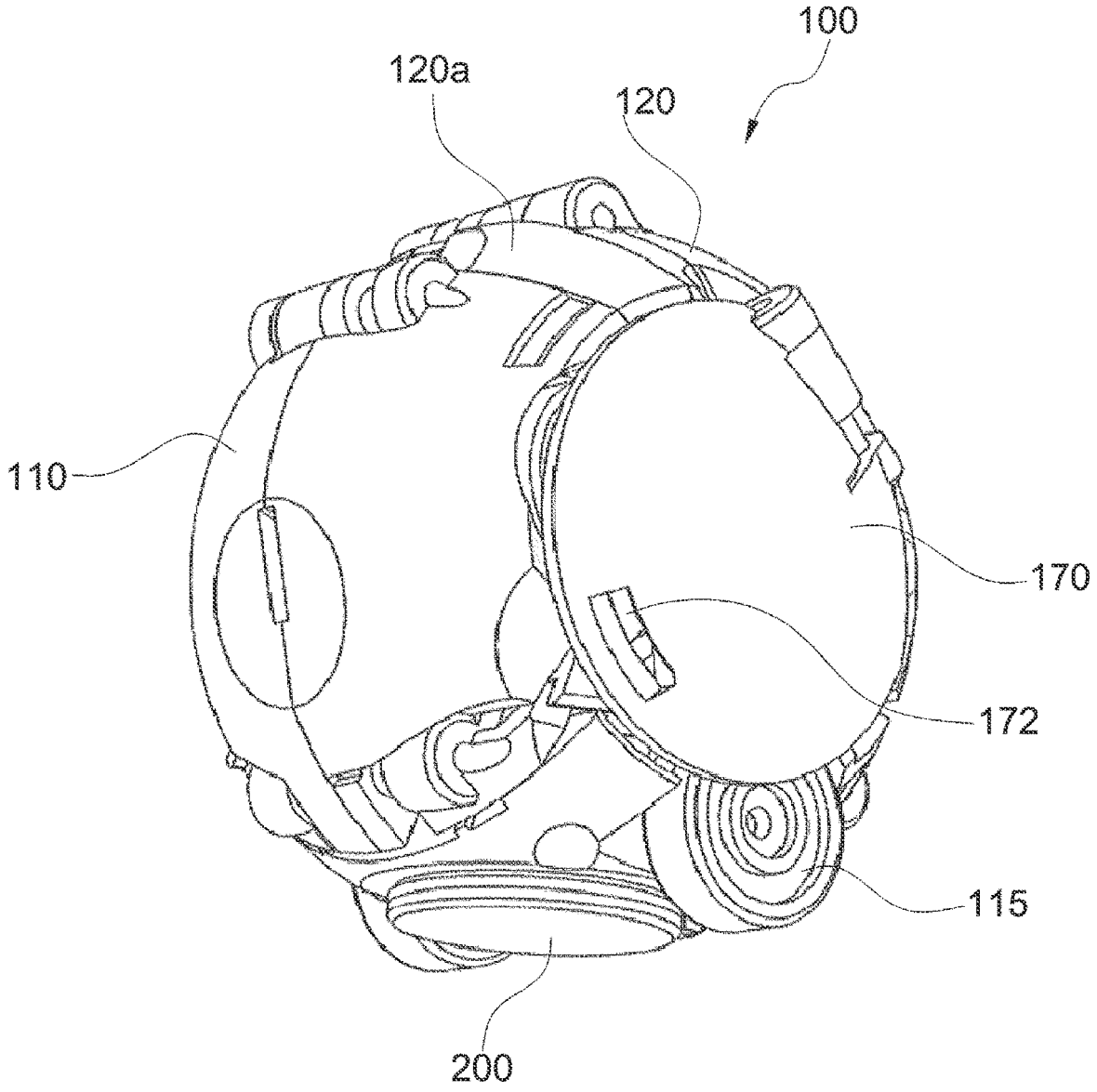

[FIG. 3]
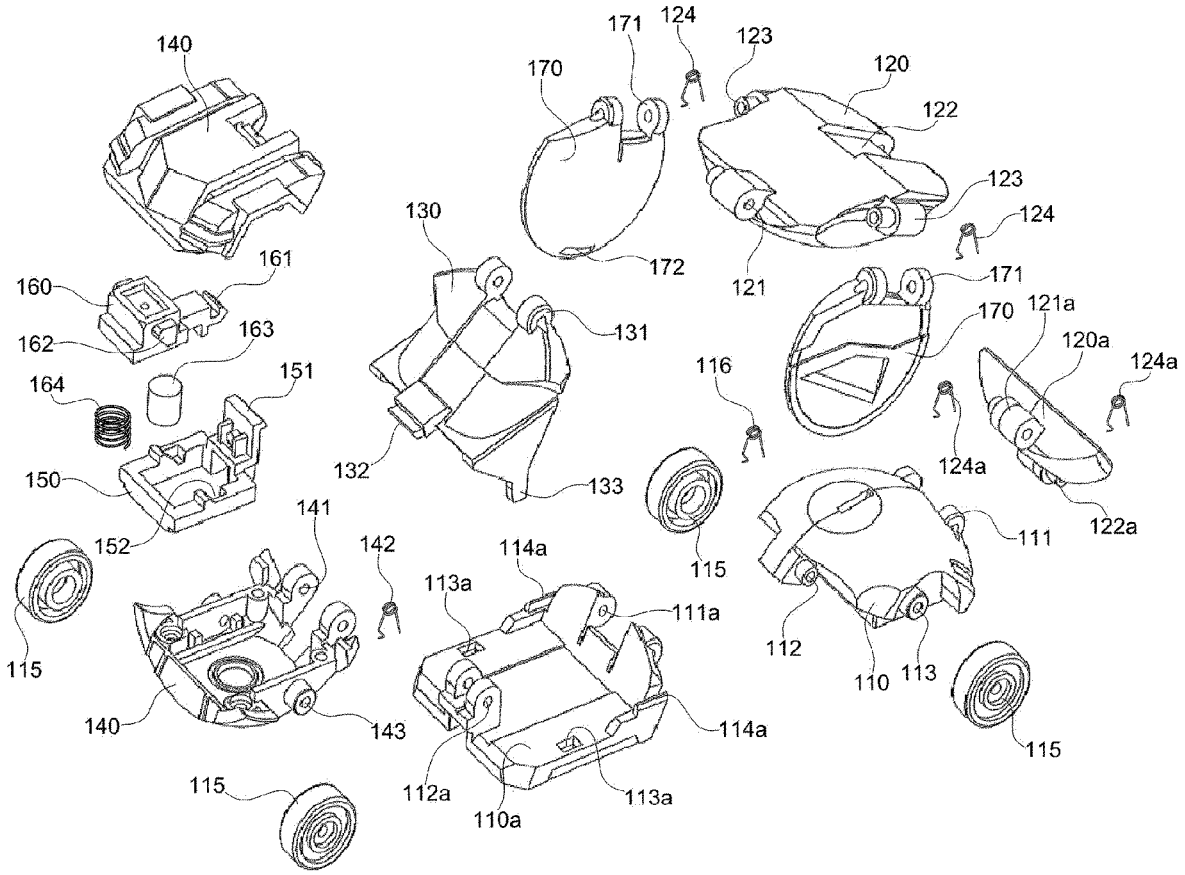

[FIG. 4]
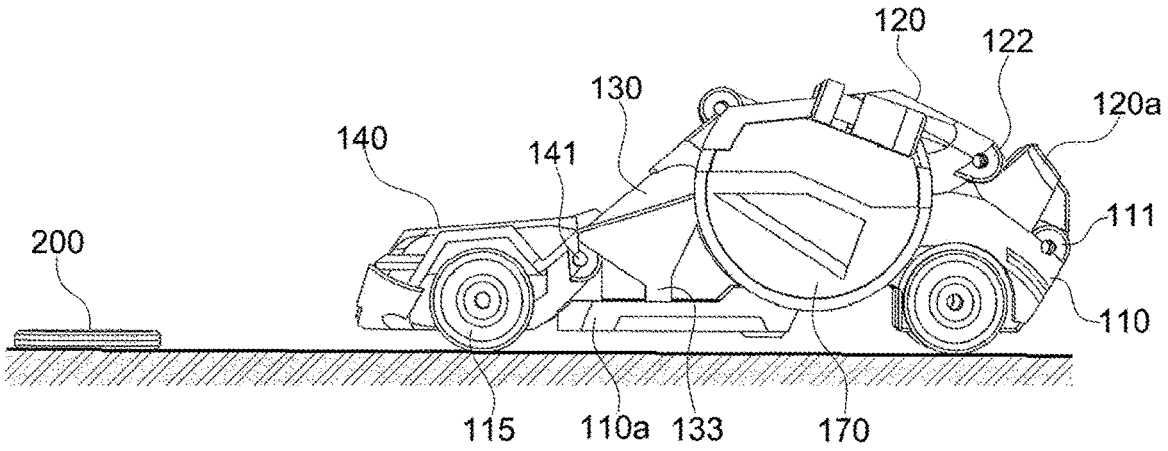
[FIG. 5]
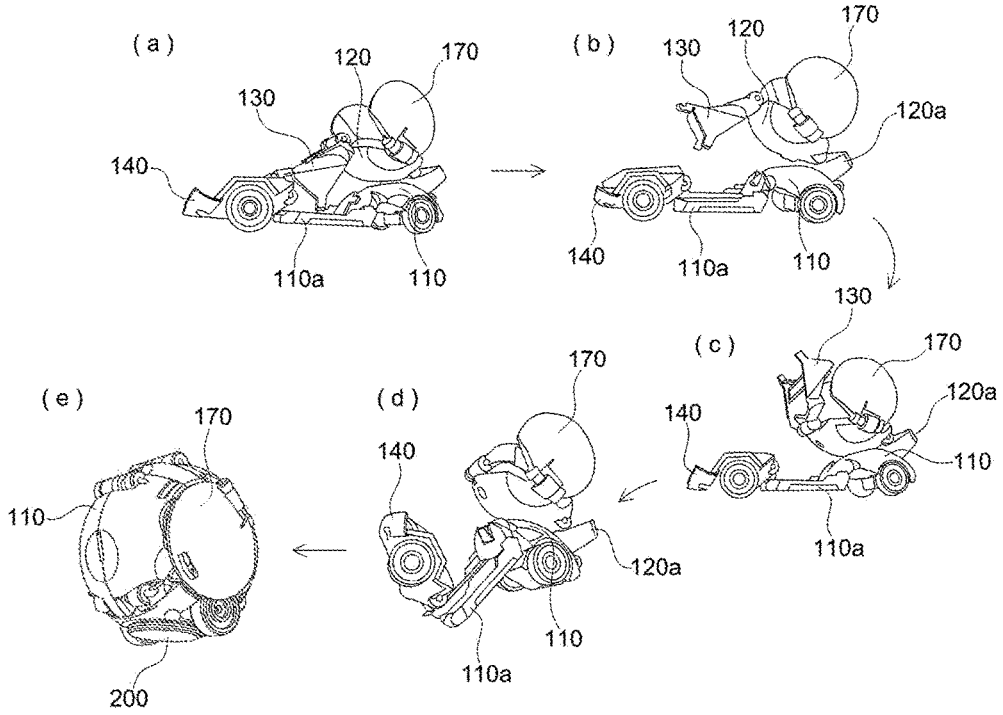

[FIG. 6]
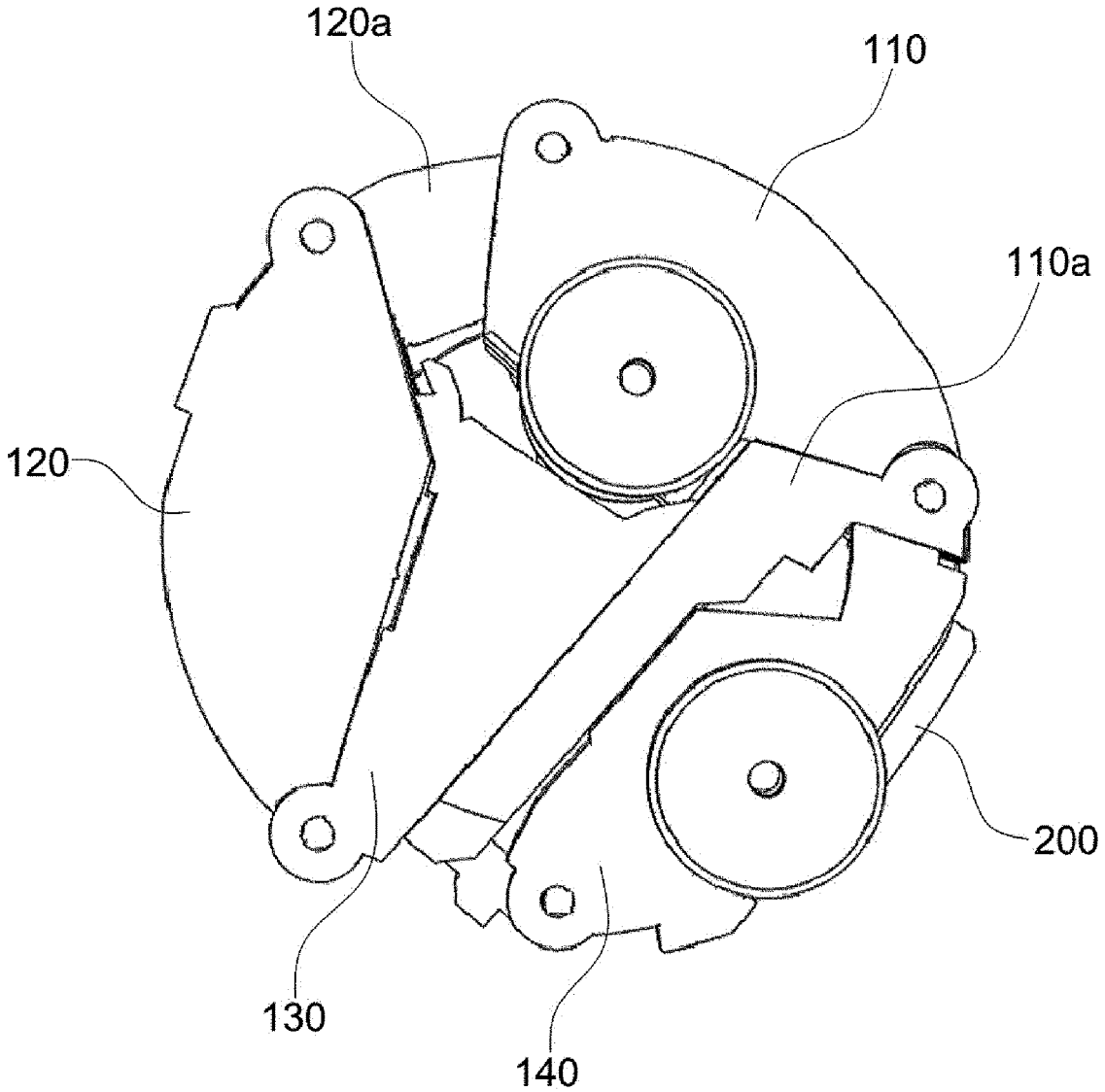

[FIG. 7]
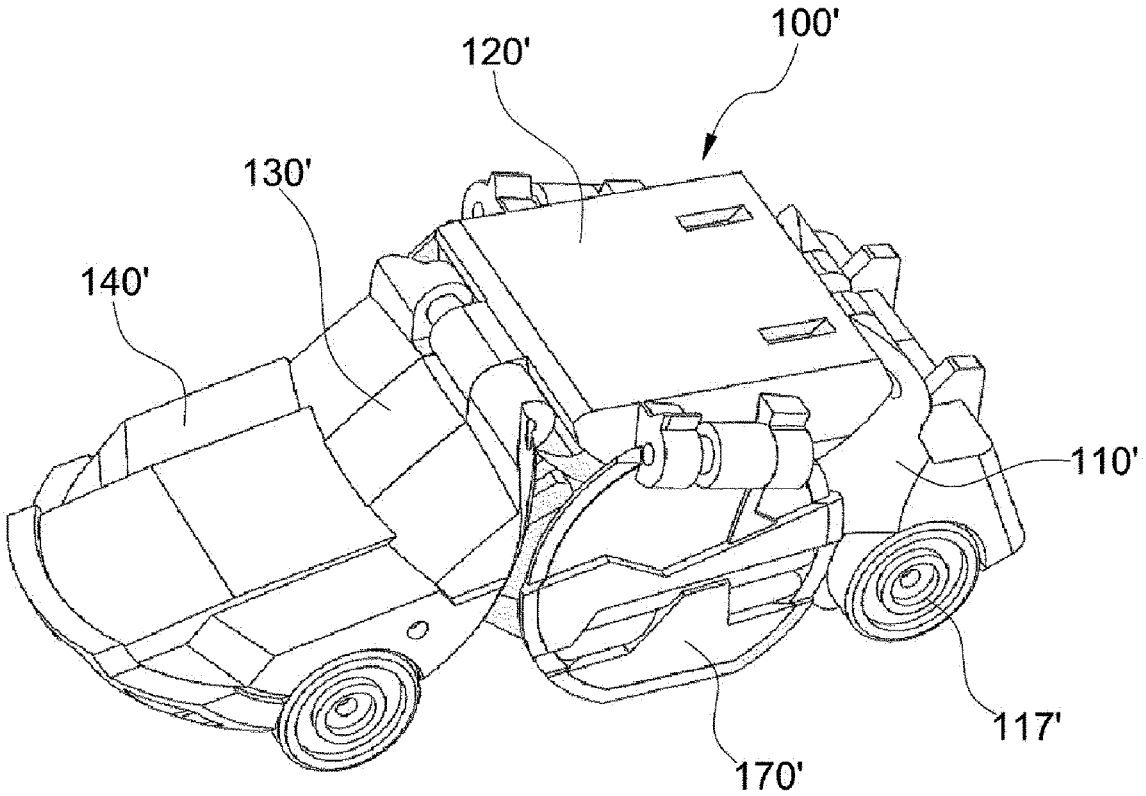

[FIG. 8]
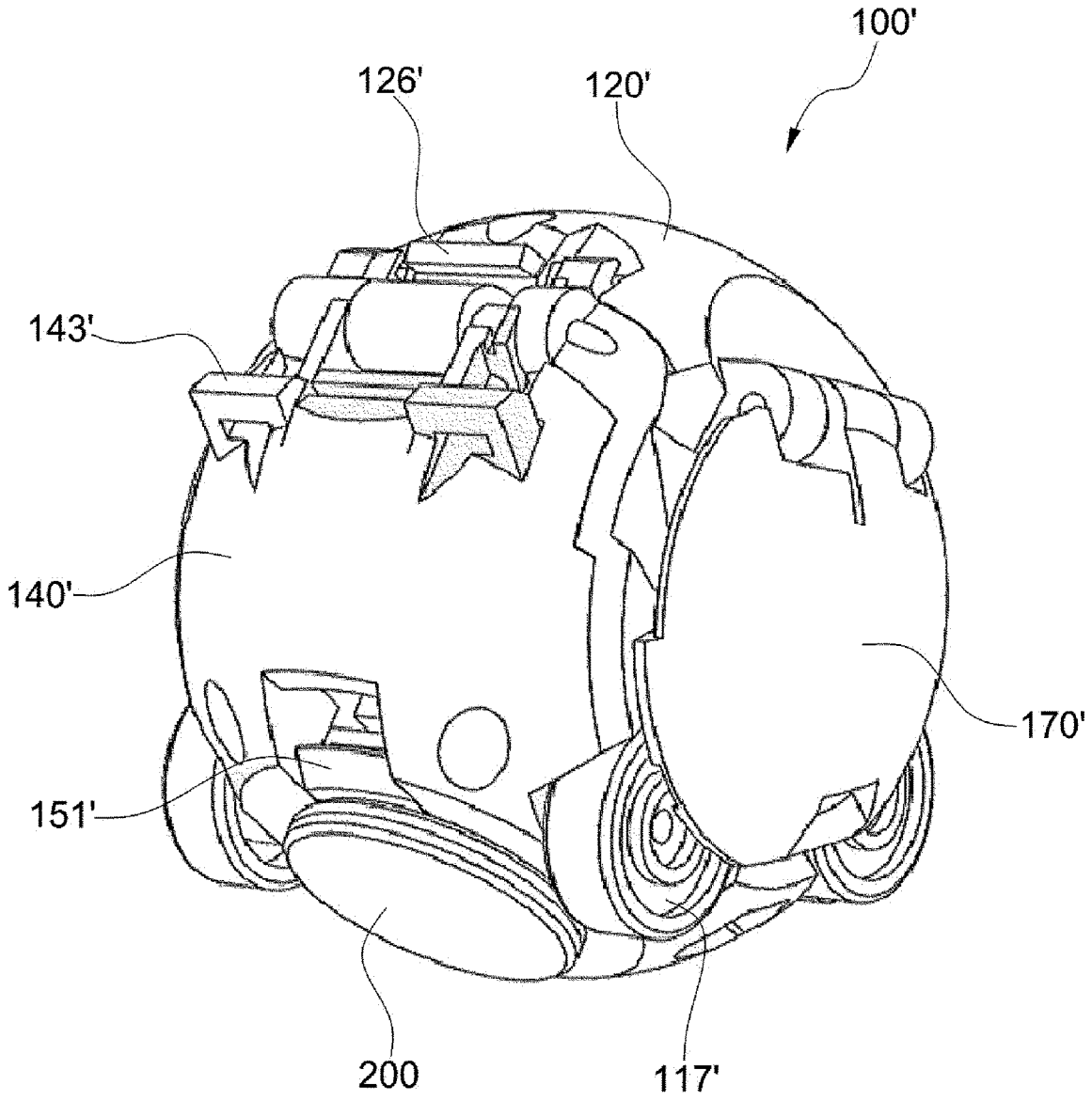

[FIG. 9]
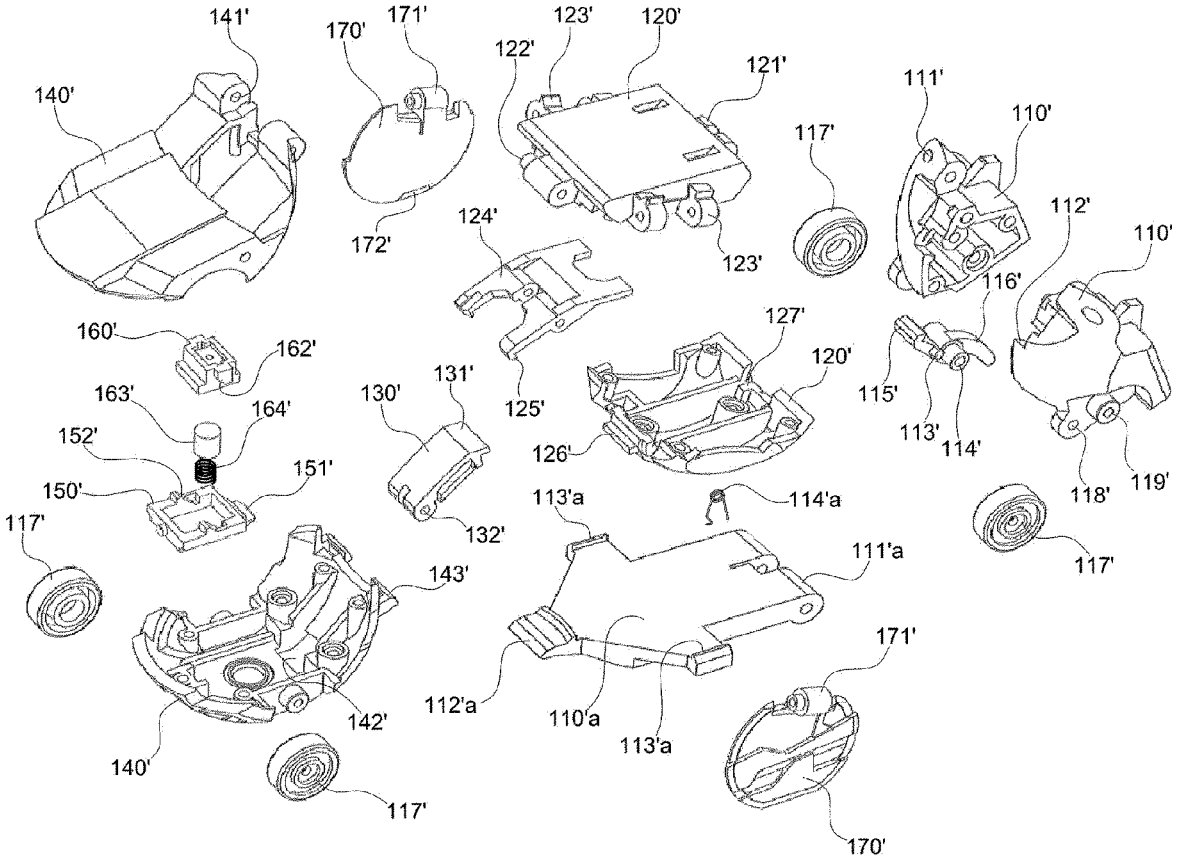

[FIG. 10]
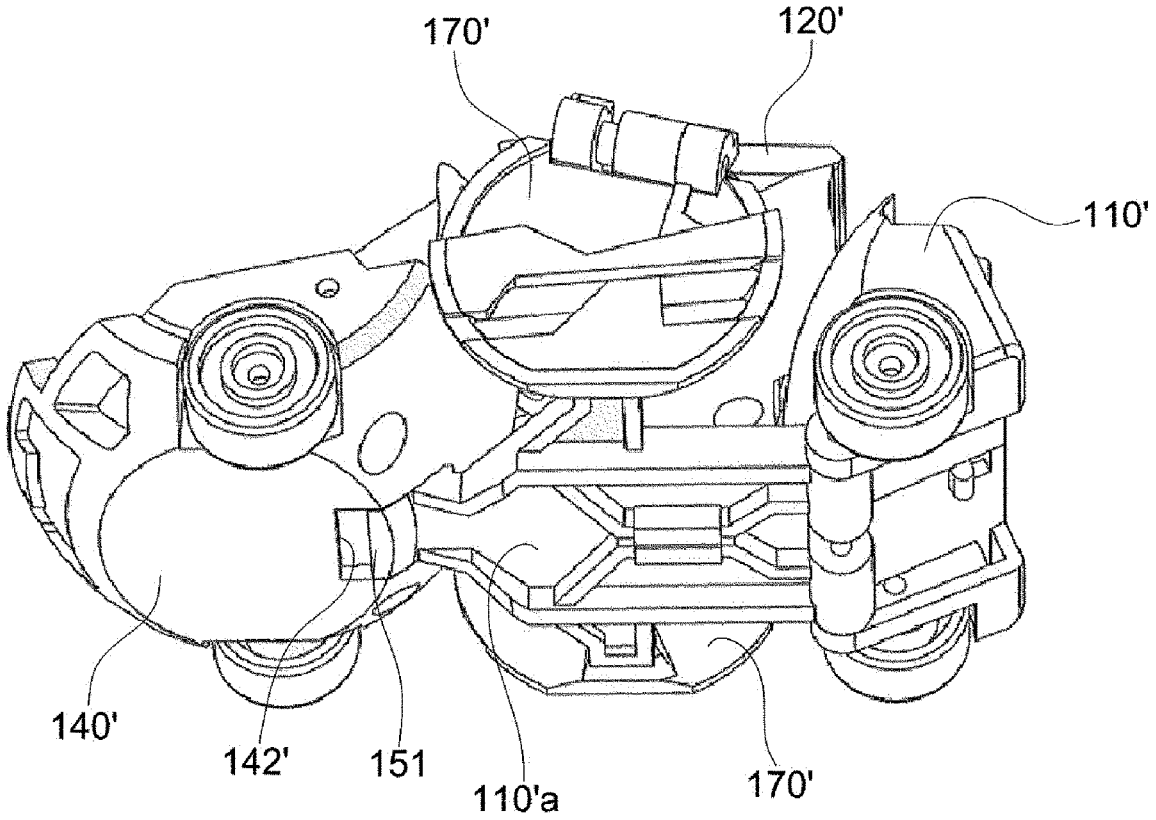

[FIG. 11]
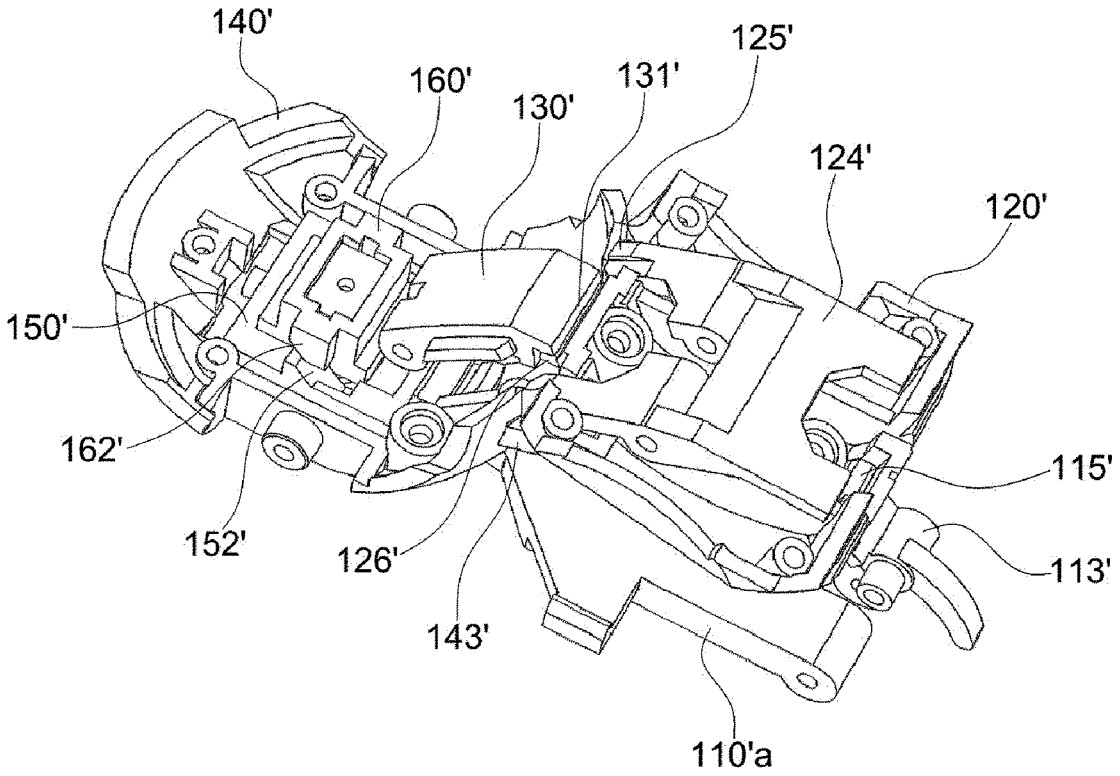
[FIG. 12]
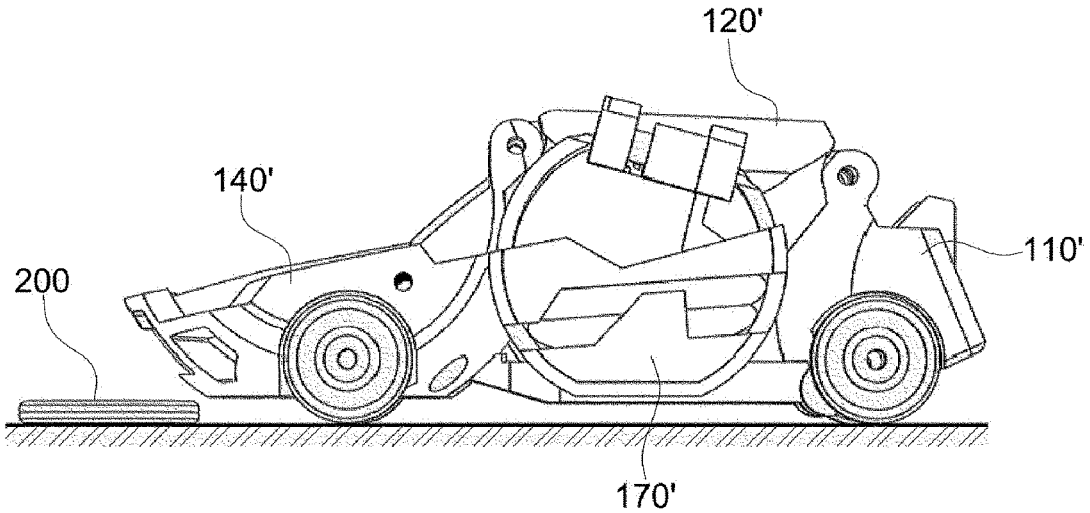

[FIG. 13]
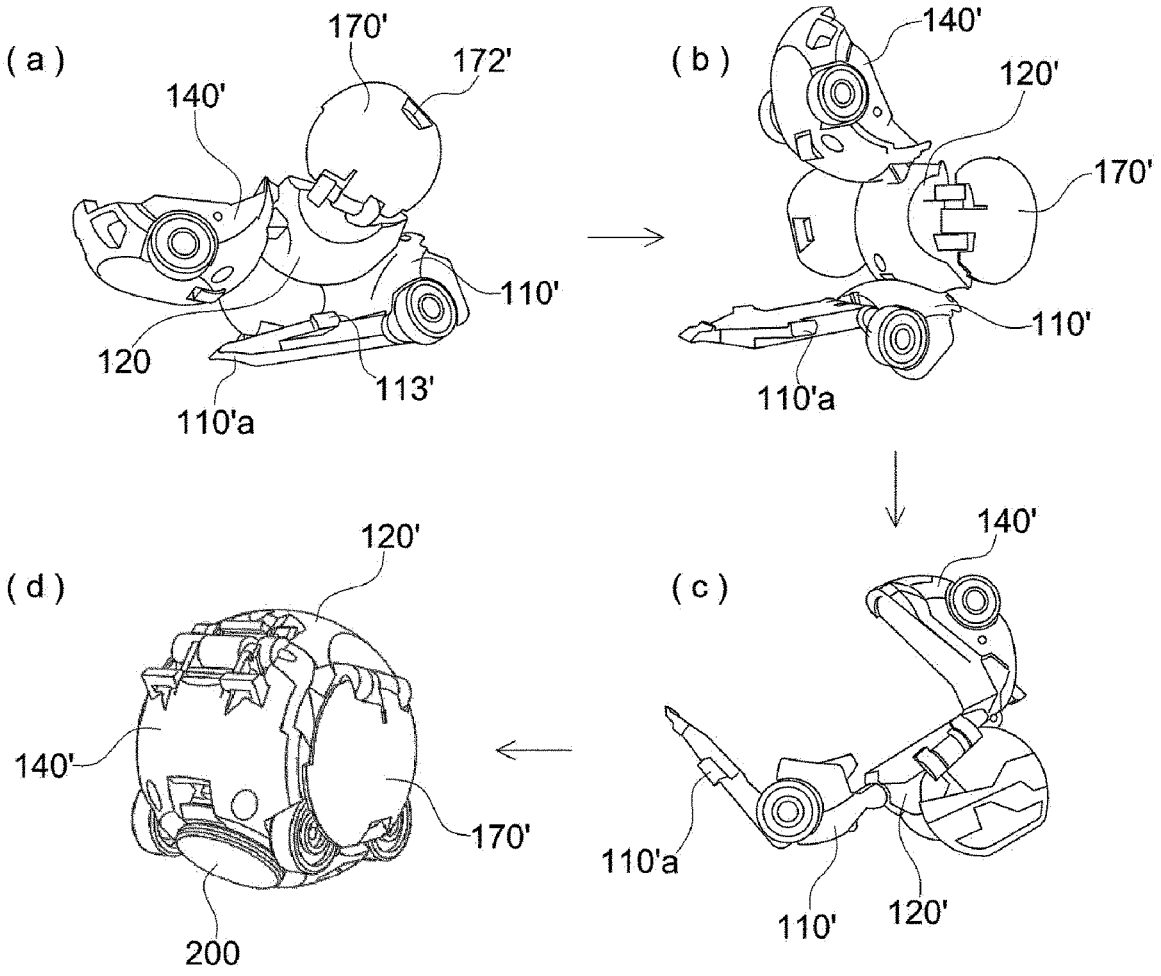

[FIG. 14]
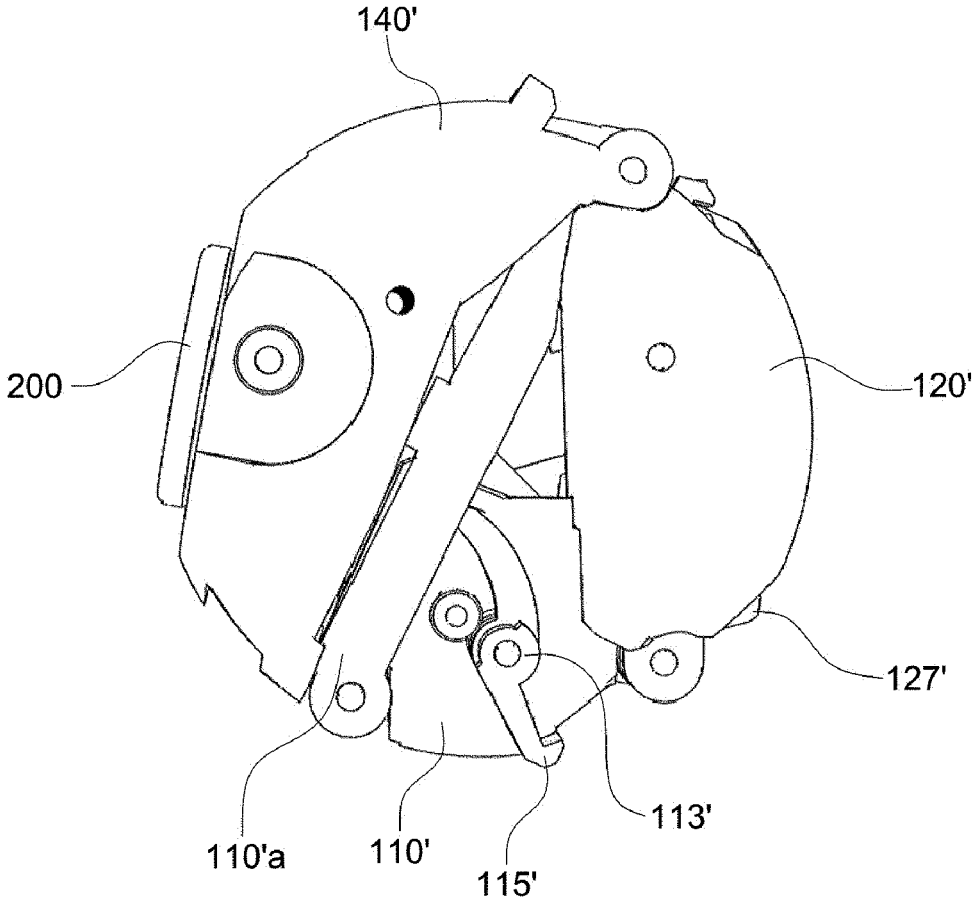

【FIG. 15】
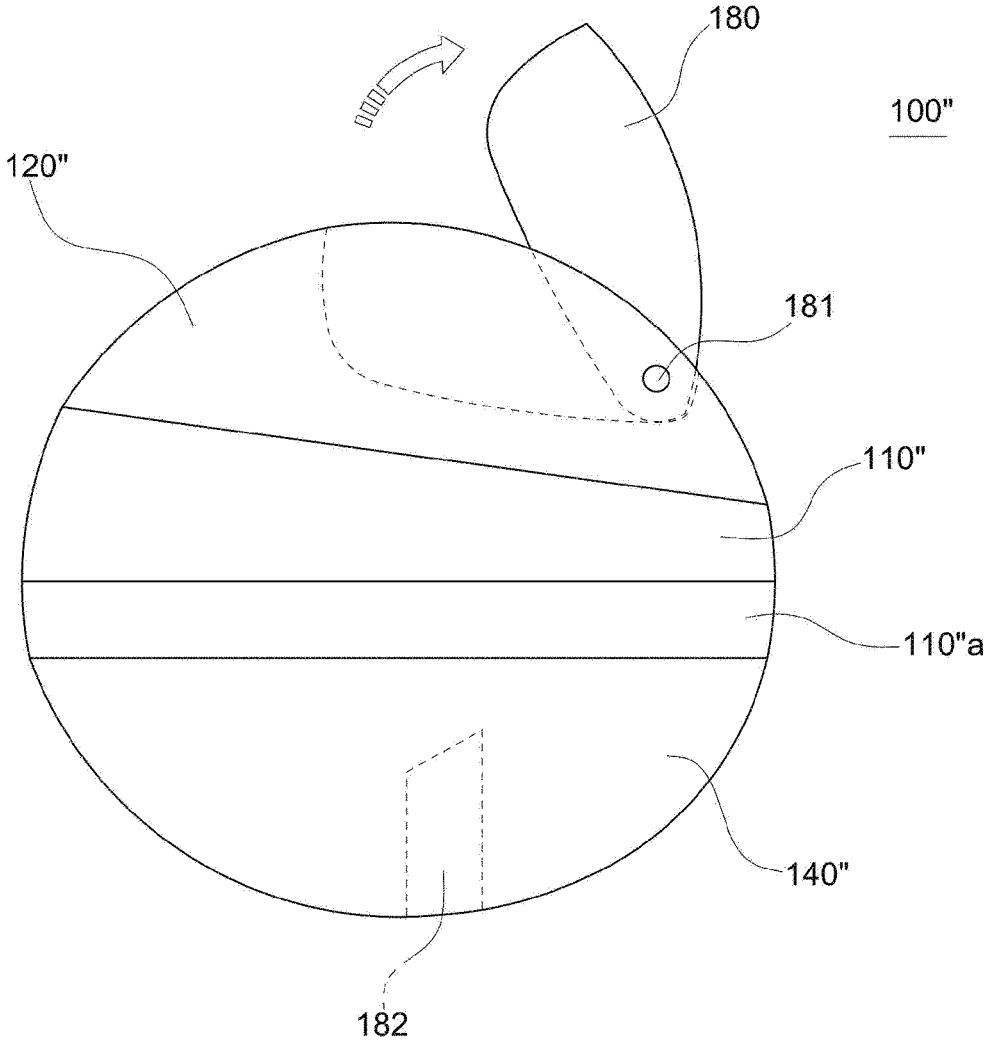

【FIG. 16】
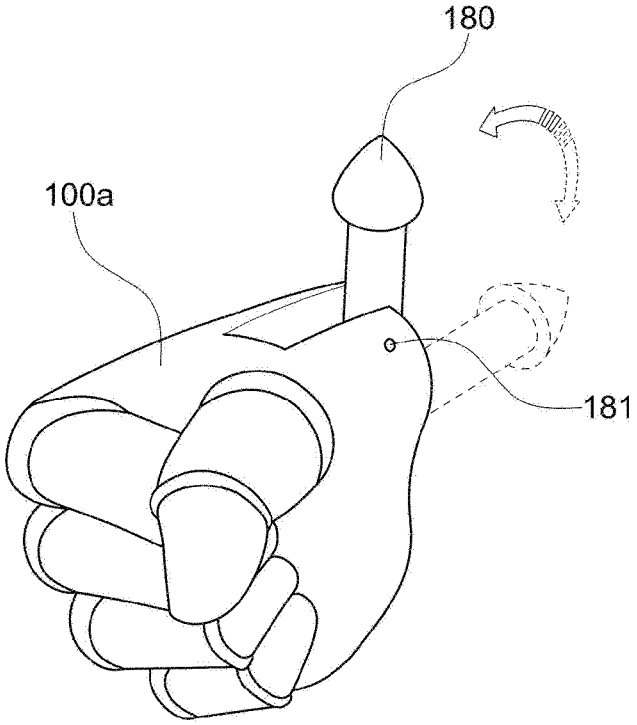

【FIG. 17】
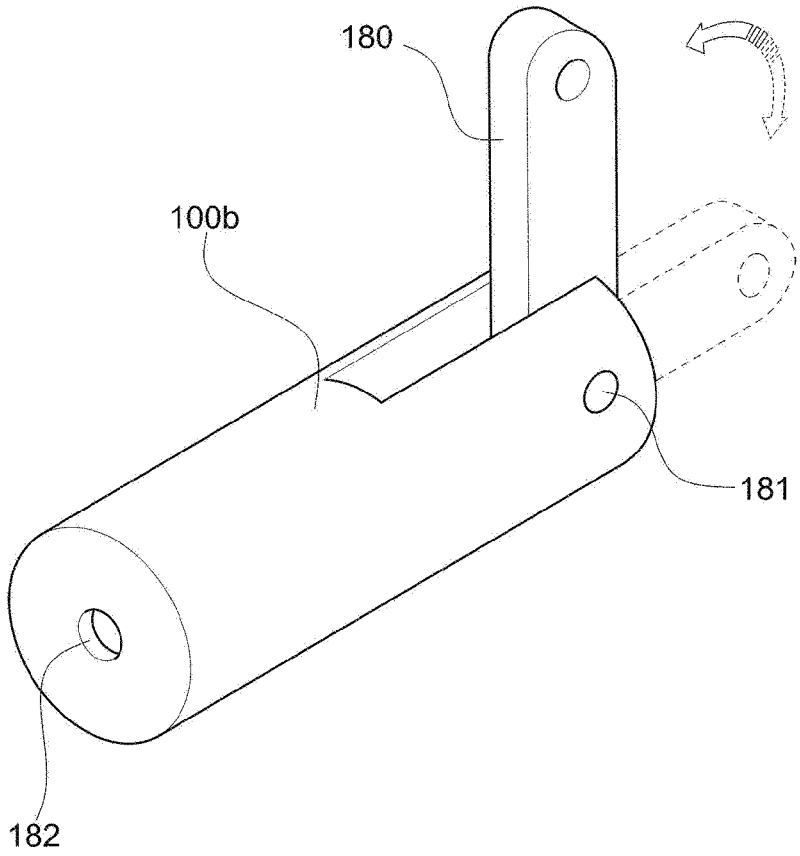

【FIG. 18】
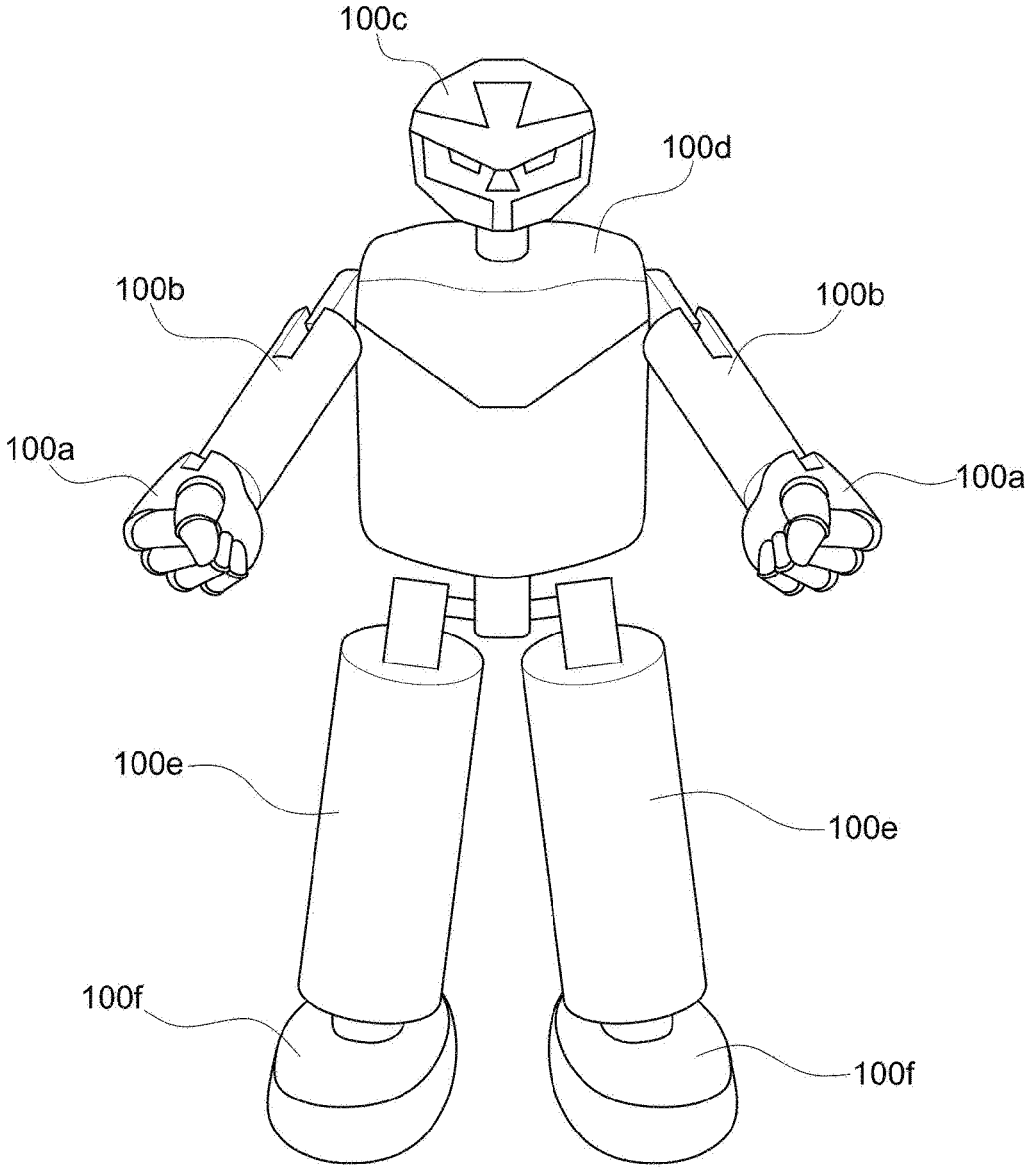

FOLDABLE TOY

CROSS-REFERENCE TO RELATED APPLICATIONS

This application is a U.S. National Phase Patent Application of International Patent Application Number PCT/KR2019/008703, filed on Jul. 15, 2019, which claims priority to Korean Patent Application No. 10-2019-0055764, filed on May 13, 2019, the entire content of all of which is incorporated by reference herein.

BACKGROUND

1. Field

Aspects of embodiments of the present disclosure relate to a foldable toy. More particularly, aspects of embodiments of the present disclosure relate to a foldable toy that is capable of being folded from a first shape into a second shape in a dosed state.

2. Description of the Related Art

A transformable toy has various toy bodies that are formed in a robot shape, a car shape, or the like, in which the toy bodies are assembled such that the toy can be transformed into a robot toy or a car toy. Because a variety of shapes can be represented with a single toy, children may enjoy a variety of play styles through transformation while directly assembling the toy.

Recently, as an example of a toy having an appearance that can be transformed from a first shape to a second shape, a transformable car toy has been proposed that may be transformed from the car shape to a different shape when an arbitrary card is attached to the lower portion of the car, such that the car is erected or overturned to expose the bottom surface of the attached card.

A comparative example of a transformable toy having an appearance that is transformed from a first shape into a second shape is disclosed in Korean Patent No. 10-1327305 (entitled "Transformable Car Toy and Play Device Using the Same").

The transformable car toy according to the comparative example is configured such that, when auxiliary bodies fixed to a body in a first shape of a car shape are unlocked, the auxiliary bodies are transformed into a second shape of a robot shape by being separated and unfolded from the body.

However, because the transformable toy according to the comparative example is configured to be unfold by unlocking the fixed auxiliary bodies, it may be inconvenient to carry the toy because the toy may generally maintain the robot shape after transformation is completed.

In addition, the transformable toy according to the comparative example may require a complex assembly process to be performed in a reverse transformation process in order to restore the auxiliary bodies from the unfolded second shape to the first shape.

Moreover, in the transformable toy according to the comparative example, it may be possible to predict the first shape before the transformation and the second shape after the transformation, which may result in a reduction of interest in play.

In other words, when in the first shape before the transformation, it may be possible to recognize the appearance of the second shape, or when in the second shape, it may be possible to recognize the appearance of the first shape, which may result in a reduction of a sense of mystery of the toy.

The above information disclosed in this Background section is for enhancement of understanding of the background of the present disclosure, and therefore, it may contain information that does not constitute prior art.

SUMMARY

Embodiments of the present disclosure are directed to a foldable toy that is capable of being folded from a first shape into a second shape in a dosed state, and in which the first shape may not be determined or recognized from the second shape in the dosed state. Embodiments of the present disclosure are directed to a foldable toy in which, the second shape of the toy, after the toy in the first shape is automatically folded, includes various suitable shapes, for example, such as a disk, a cylinder, a sphere, a polyhedron, a character shape, a part of a character (e.g., a head, an arm, a leg, or a trunk), and/or the like.

According to one or more embodiments of the present disclosure, a foldable toy includes: a body part; a support part movably connected to the body part; at least one movable body part movably connected to at least one of the body part or the support part; and a locking part configured to fix the moveable body part in a first position to lock the foldable toy in a first shape in which the body part, the support part, and the movable body part are deployed. When the locking part is unlocked, the movable body part is configured to move to a second position, and the foldable toy is configured to be folded into a second shape in which the body part, the support part, and the movable body part are stacked on one another.

In an embodiment, when the locking part is unlocked, the support part and the movable body part may be configured to move to the second position and may be stacked with the body part through a forward rotation and a reverse rotation about the body part.

In an embodiment, when the support part and the movable body part are moved to be stacked with the body part, the support part may be orientated between a floor and at least the body part to space the body part from the floor.

In an embodiment, the locking part may include a latch part configured to move from a first position to a second position in response to a reaction with a transformation induction part to unlock the locking part.

In an embodiment, the reaction may include an attractive force applied to the latch part through a magnetic field or a physical contact with the transformation induction part.

In an embodiment, the movable body part may include: a first body part; a second body part configured to rotate in a forward direction or a reverse direction about the body part; and a third body part configured to rotate about the body part in a direction orthogonal to a rotational direction of the first body part and the second body part.

In an embodiment, the first body part may be connected to the body part, and may be configured to move in a top-down direction with respect to the body part, and the second body part may be connected to the support part, and may be configured to move in a bottom-up direction with respect to the body part to be folded towards the body part.

In an embodiment, the first body part may be connected to the body part, and the second body part may be connected to a side of the first body part and configured to rotate in a top-down direction with respect to the body part to be folded towards the body part.

In an embodiment, the first shape before folding may include a moving means.

In an embodiment, the second shape after folding may be one of a disk, a cylinder, a sphere, or a polyhedron.

In an embodiment, the foldable toy may further include: a fastening part configured to be drawn out from the body part or rotatable via a fastening part rotation shaft to be connected to another foldable toy.

In an embodiment, the body part may have a fastening groove to be connected with a fastening part of the other foldable toy.

In an embodiment, the foldable toy may be configured to be connected to a plurality of foldable toys via the fastening part and the fastening groove to form a third shape along with the plurality of foldable toys.

According to embodiments of the present disclosure, the toy may be folded from a first shape into a second shape in a closed state, and it may be difficult or impossible to recognize the first shape from the second shape in the dosed state. Thus, it may be possible to provide a sense of mystery of the toy.

According to embodiments of the present disclosure, the toy may be configured such that, when the toy is in the state of being unfolded and maintaining or substantially maintaining the first shape, the toy may be automatically folded into the second shape. The second shape after folding may include various suitable shapes, for example, such as a disk, a cylinder, a sphere, a polyhedron, a character shape, a part of the character (e.g., a head, an arm, a leg, or a trunk), and/or the like. Thus, it may be possible to use the toy in various suitable games or play styles.

BRIEF DESCRIPTION OF THE DRAWINGS

The above and other aspects and features of the present disclosure will be more clearly understood from the following detailed description of the illustrative, non-limiting example embodiments with reference to the accompanying drawings.

FIG. 1 is a perspective view illustrating a first shape of a foldable toy according to an embodiment of the present disclosure.

FIG. 2 is a perspective view illustrating a second shape of the foldable toy according to the embodiment of FIG. 1.

FIG. 3 is an exploded perspective view illustrating a configuration of the foldable toy according to the embodiment of FIG. 1.

FIG. 4 is an example view illustrating an operation of the foldable toy according to the embodiment of FIG. 1.

FIG. 5 is an example view illustrating an operation process of the foldable toy according to the embodiment of FIG. 1.

FIG. 6 is an example side view illustrating a second shape of the foldable toy according to the embodiment of FIG. 1.

FIG. 7 is a perspective view illustrating a first shape of a foldable toy according to another embodiment of the present disclosure.

FIG. 8 is a perspective view illustrating a second shape of the foldable toy according to the embodiment of FIG. 7.

FIG. 9 is an exploded perspective view illustrating a configuration of the foldable toy according to the embodiment of FIG. 7.

FIG. 10 is a perspective view illustrating a lower portion of the foldable toy according to the embodiment of FIG. 7.

FIG. 11 is a perspective view illustrating an internal configuration in a partially disassembled state of the foldable toy according to the embodiment of FIG. 7.

FIG. 12 is an example view illustrating an operation of the foldable toy according to the embodiment of FIG. 7.

FIG. 13 is an example view illustrating an operation process of the foldable toy according to the embodiment of FIG. 7.

FIG. 14 is an example side view illustrating a structure of a second shape of the foldable toy according to the embodiment of FIG. 7.

FIG. 15 is a side view illustrating a first shape of a foldable toy according to another embodiment of the present disclosure.

FIG. 16 is a perspective view illustrating a second shape of a foldable toy according to another embodiment of the present disclosure.

FIG. 17 is a perspective view illustrating a second shape of a foldable toy according to another embodiment of the present disclosure.

FIG. 18 is a perspective view illustrating a third shape of a foldable toy according to an embodiment of the present disclosure.

DETAILED DESCRIPTION

Hereinafter, embodiments of a transformable toy will be described in more detail with reference to the accompanying drawings, in which like reference numbers refer to like elements throughout. In the drawings, the relative sizes of elements, members, parts, and regions and the thicknesses of the lines may be exaggerated and/or simplified for clarity.

It will be understood that when an element, member, part, or feature is referred to as being "on," "connected to," or "coupled to" another element, member, part, or feature, it can be directly on, connected to, or coupled to the other element, member, part, or feature, or one or more intervening elements, members, parts, or features may be present.

In addition, terms such as "part", "device", "module", and the like refers to a unit for processing at least one function or operation, and may be classified into hardware, software, or a combination thereof.

First Embodiment

FIG. 1 is a perspective view illustrating a first shape of a foldable toy according to an embodiment of the present disclosure. FIG. 2 is a perspective view illustrating a second shape of the foldable toy according to the embodiment of FIG. 1. FIG. 3 is an exploded perspective view illustrating a configuration of the foldable toy according to the embodiment of FIG. 1. FIG. 4 is an example view illustrating an operation of the foldable toy according to the embodiment of FIG. 1. FIG. 5 is an example view illustrating an operation process of the foldable toy according to the embodiment of FIG. 1. FIG. 6 is an example side view illustrating a second shape of the foldable toy according to the embodiment of FIG. 1.

Referring to FIGS. 1 to 6, a foldable toy 100 according to a first embodiment of the present disclosure includes a body part 110, a support part 110*a* movably installed on the body part 110, at least one movable body part movably installed on at least one of the body part or the support part 110*a*, and a locking part 150 installed on the movable body part to be connected with (e.g., coupled with) the support part 110*a* to support the movable body part such that the movable body part maintains or substantially maintains a first position. When the locking part 150 is unlocked, the support part 110*a* and the movable body part move to a second position through a clockwise forward rotation and a counterclockwise reverse rotation about the body part 110, so that the foldable toy 100 is folded into a second shape having a structure in which the body part 110, the support part 110*a*, and the movable body part are stacked on one another.

As another example, the foldable toy 100 includes a body part 110, a support part 110*a*, a movable body part, a locking part 150, a latch part 160, third body parts 170, and a transformation induction part 200. The movable body part may include a first body part 120, a first auxiliary body part 120*a*, a link part 130, and a second body part 140.

The first shape of the foldable toy 100 before being folding is shown in the figures as a car shape for convenience of illustration, but the present disclosure is not limited thereto. For example, the first shape may be variously modified to include a shape of an airplane, a ship, a rocket, an animal, an insect, a character, a building, an object, or the like, and may include (e.g, may be equipped with) a suitable moving means, for example, such as wheels and/or the like. The first shape may include various suitable shapes including the moving means, such that the foldable toy 100 may be capable of traveling on a floor (or the ground).

In addition, the second shape of the foldable toy 100 after folding is shown in the figures as a spherical shape for convenience of illustration, but the present disclosure is not limited thereto. For example, the second shape may be variously modified to include a partial shape, such as a disk, a cylinder, a polyhedron, a character shape, or a character's head, arm, leg, and/or body, and/or may be configured in a suitable shape in which the outside thereof is completely or substantially closed, so as to hide the internal structure or appearance of the foldable toy 100 (e.g., to make the internal structure or appearance of the foldable toy 100 invisible or not capable of being determined or recognized).

The body part 110 is a member constituting a base of the foldable toy 100, and rotatably supports the support part 110*a*, the first body part 120, and the movable body parts, for example, such as the first auxiliary body part 120*a*. At least a portion of the external surface of the body part 110 includes a curved surface (e.g., a spherical or semi-spherical shaped surface having a curvature).

In addition, the body part 110 is rotatably connected to the first body part 120 or the first auxiliary body part 120*a* via a body part first hinge 111 formed on a side (e.g., on one side) of the body part 110.

The support part 110*a* is rotatably connected to the body part 110 via a body part second hinge 112 formed on another side of the body part 110.

The first body part 120, the first auxiliary body part 120*a*, and the support part 110*a* may be rotated using an elastic force of springs 116 and 124.

Body part third hinges 113 are formed on opposite sides of the body part 110, and wheels 115 are connected to (e.g., coupled to) the body part third hinges 113.

The support part 110*a* is a plate-shaped member, and is rotatably connected to the body part second hinge 112 via a support part first hinge 111*a*. A support part second hinge 112*a* is formed (e.g., is installed) on another side of the support part 110*a*, and is rotatably connected to the second body part 140.

In addition, the support part 110*a* is configured to rotate about the body part 110 in a counterclockwise direction (or in a direction away from the second body part 140 as shown in FIG. 5) during the folding operation.

The support part 110*a* includes support part coupling grooves 113*a*, such that the link part 130 may be fixed when a portion of the link part 130 is inserted into the support part coupling grooves 113*a*.

In addition, the support part 110*a* includes support part coupling protrusions 114*a* on opposite side surfaces thereof, so that when the coupling protrusions 114*a* are connected with (e.g., coupled with) portions of the third body parts 170, the third body parts 170 are fixed to the opposite sides of the support part 110*a*.

The support part 110*a* presses against a floor using the elastic force of the spring 116, so that the body part 110 is capable of maintaining or substantially maintaining a state of floating above (e.g., a state of being spaced apart from) the floor while the support part 110*a* rotates.

The first body part 120 is a member constituting a portion of the foldable toy 100, and is installed to be rotatable clockwise (e.g., in an opposite direction of that of the support part 110*a*) about the body part 110 during the folding operation. At least a portion of the external surface of the first body part 120 includes the curved surface (e.g., the spherical or semi-spherical surface having a curvature).

The first body part 120 is rotatably connected to the link part 130 via a first body part first hinge 121 formed on a side (e.g., on one side) of the first body part 120, and is rotatably connected to the body part 110 or the first auxiliary body part 120*a* via a first body part second hinge 122 formed on another side of the first body part 120.

The first body part 120 includes first body part third hinges 123 on opposite sides of the first body part 120 to be connected to the third body parts 170, respectively, and is configured to be rotatable using an elastic force of a spring (not illustrated).

The first auxiliary body part 120*a* is a component that helps (e.g., that assists) to maintain or substantially maintain the second shape after folding, which may be a spherical shape as shown in the figures, and enables the first body part 120 to exhibit a large rotation radius or motion. At least a portion of the external surface of the first auxiliary body part 120*a* includes a curved surface (e.g., a spherical or semi-spherical surface having a curvature).

The first auxiliary body part 120*a* includes a first auxiliary body part first hinge 121*a* on a side (e.g., on one side) of the first auxiliary body part 120*a* to be connected with the first body part second hinge 122, and a first auxiliary body part second hinge 122*a* on another side of the first auxiliary body part 120*a* to be connected with the body part first hinge 111.

However, the present disclosure is not limited thereto, and the first auxiliary body part 120*a* may be omitted as necessary or desired, for example, according to a shape of the first shape and/or the second shape.

The link part 130 is a component that supports the second body part 140 and the first body part 120 installed on the support part 110*a*, such that the second body part 140 and the first body part 120 are connected to each other to allow the foldable toy 100 to maintain or substantially maintain the first shape before folding. The link part 130 is configured to be connected to the first body part first hinge 121 via a link part hinge 131 provided on a side (e.g., on one side) of the link part 130, and may be rotatable counterclockwise (e.g., in the same or substantially the same direction as that of the support part 110*a*) during the folding operation using an elastic force of a spring (not illustrated).

The link part 130 includes a link part first coupling protrusion 132 on another side of the link part 130 to be connected to (e.g., coupled to) the locking part 150.

In addition, the link part 130 includes a link part second coupling protrusion 133, which protrudes from the link part 130 by a suitable length (e.g., a predetermined length), so as to be connected to (e.g., coupled to) the support part coupling groove 113*a*.

The second body part 140 is a member constituting a portion of the foldable toy 100. The second body part 140 has a storage space formed therein, and the locking part 150 and the latch part 160 are installed in the storage space. A portion of the external surface of the second body part 140 is formed as a curved surface having a curvature.

The second body part 140 is connected to the support part second hinge 112*a* via a second body part first hinge 141 provided on a side (e.g., on one side) of the second body part 140, and is configured to be rotatable in a direction opposite to the rotation direction of the support part 110*a* using the elastic force of the spring 142, so as to be stacked on the support part 110*a* after folding.

In addition, the second body part 140 includes second body part second hinges 143, so that wheels 115 are installed thereon.

The locking part 150 is installed inside the second body part 140 to be movable in a horizontal direction with respect to an upright orientation of the foldable toy 100 shown in the figures, and includes a locking part coupling protrusion 151 on a side (e.g., on one side) thereof. The locking part coupling protrusion 151 engages the link part first coupling protrusion 132, so as to maintain or substantially maintain the locked state in which the link part 130 is fixed.

In addition, the locking part 150 includes locking part inclined surfaces 152 having a suitable angle (e.g., a predetermined angle) on opposite sides of the locking part 150.

The latch part 160 is installed on the locking part 150, so as to be movable in a vertical direction with respect to the upright orientation of the foldable toy 100 shown in the figures, and includes a latch part coupling protrusion 161 on a side (e.g., on one side) thereof. The latch part coupling protrusion 161 engages the support part 110*a*, such that the support part 110*a* maintains or substantially maintains a locked state in which the support part 110*a* is fixed.

In addition, the latch part 160 includes latch part inclined surfaces 162 having a suitable angle (e.g., a predetermined angle) on opposite sides of the latch part 160. The latch part inclined surfaces 162 are configured to engage the locking part inclined surfaces 152. Thus, when the latch part 160 moves in the vertical direction, the locking part 150 is capable of moving in the horizontal direction.

The latch part 160 includes a magnet 163 so as to form a magnetic field with the transformation induction part 200, which moves the latch part 160 in the vertical direction when the magnetic field with the transformation induction part 200 is formed.

In addition, when the magnetic field between the magnet 163 and the transformation induction part 200 disappears (e.g., is no longer formed), the latch part 160 provides an elastic force via a spring 164 such that the latch part 160 returns to its original position (e.g., a relaxed position).

While a configuration in which the latch part 160 is moved through an attractive force by a magnetic field between the magnet 163 and the transformation induction part 200 is described above, the present disclosure is not limited thereto. For example, in another embodiment, the latch part 160 and the transformation induction part 200 may be configured to be moved through a physical contact.

In other words, an operation bar (not illustrated) may be further configured on one side or the bottom surface of the latch part 160 to extend by a suitable length (e.g., a predetermined length) from the latch part 160 to be exposed to the outside, such that when the exposed operation bar comes into physical contact with the transformation induction part 200, the latch part 160 may be moved to unlock the locking part 150.

The third body parts 170 are members provided on opposite sides of the first body parts 120 so as to constitute a portion of the foldable toy 100, and at least a portion of the external surface of each of the third body parts 170 includes a curved surface (e.g., a spherical or semi-spherical surface having a curvature).

Each of the third body parts 170 includes a third body part hinge 171 on a side (e.g., on one side) thereof, so as to be connected to a corresponding first body part third hinge 123 via the third body hinge 171. Each of the third body parts 170 is configured to be rotatable in a direction perpendicular to or substantially perpendicular to the rotatable direction of the first body part 120 using an elastic force of a spring (not illustrated).

In other words, the third body parts 170 are configured to rotate in a forward direction and a reverse direction about the center of the body part 110 in a direction orthogonal to or substantially orthogonal to the rotatable direction (e.g., a rotational direction) of the first body part 120 and the second body part 140.

The third body parts 170 include third body part coupling grooves 172, respectively, and the third body part coupling grooves 172 are connected to (e.g., are coupled with) the support part coupling protrusions 114*a*, thereby allowing the third body parts 170 to be fixed.

While a configuration in which the third body parts 170 are rotatable is described above as an example, the present disclosure is not limited thereto. For example, in other embodiments, the third body parts 170 may be configured to be slidable according to a desired shape change direction.

The transformation induction part 200 has a plate-shaped, hemispherical, or polyhedral member having an outer shape including any suitable one of a circle, an ellipse, or a polygon, and may include (e.g., may be made of) paper, a synthetic resin, or the like.

The transformation induction part 200 includes one of a magnetic material or a magnet therein, so as to form the magnetic field with the magnet 163.

An arbitrary character, number, letter, figure, picture, or the like may be attached to the external surface of the transformation induction part 200 using a printed matter, or may be formed through engraving, embossing, or the like.

An operation process of the foldable toy 100 according to the first embodiment of the present disclosure will be described in more detail hereinafter.

First, as shown in FIG. 4, the support part 110*a* is rotated about the body part 110 in a clockwise direction of FIG. 4, and the first body part 120 and the first auxiliary body part 120*a* are rotated in a counterclockwise direction of FIG. 4 so as to be disposed at predetermined positions, respectively.

When the support part 110*a*, the first body part 120, and the first auxiliary body part 120*a* are disposed at predetermined positions, respectively, the second body part 140 installed at a distal end of the support part 110*a* is rotated in the clockwise direction, and engages the link part 130 provided at a distal end of the first body part 120 via the locking part 150 so as to be in the locked state, and the latch part 160 is engaged with the support part 110*a* so as to be in the locked state.

In addition, when the link part 130 is engaged with the support part 110*a*, and the third body parts 170 are engaged with and fixed to the support part coupling protrusions 114*a* of the support part 110*a*, the foldable toy 100 is transformed into the first shape before folding, which is shown as an example of a car shape for convenience of illustration.

The transformation induction part 200 is disposed at a position spaced apart from the foldable toy 100 by a suitable distance (e.g., a predetermined distance), and the foldable toy 100 is moved (or travels) toward the transformation induction part 200.

When the transformation induction part 200 and the magnet 163 of the foldable toy 100 react to each other to generate a magnetic field, the latch part 160 moves using the attractive force of the magnetic field, and the locking by the locking part 150 and the latch part 160 is released.

When the locking part 150 is unlocked, the link part 130 is separated from the locking part 150 (e.g., as shown in (a) of FIG. 5). In this case, the link part 130, the first body part 120, and the first auxiliary body part 120*a* are moved (e.g., by an elastic force of the spring) in a clockwise direction of FIG. 5, which is a top-down direction with respect to the body part 110, about the body part 110, thereby being folded to the body part 110 (e.g., as shown in (b) of FIG. 5).

In addition, when the latch part 160 is unlocked, the support part 110*a* is separated from the latch part 160, and the support part 110*a* and the second body part 140 are moved (e.g., by the elastic force of the spring) in a counterclockwise direction of FIG. 5, which is a bottom-up direction with respect to the body part 110, about the body part 110, thereby being folded to the body part 110 (e.g., see (d) of FIG. 5).

In this case, the body part 110, the first body part 120, the first auxiliary body part 120*a*, the link part 130, and the second body part 140 are folded to the body part 110 in a floating state with the help of the support part 110*a*.

When the support part 110*a* is moved through unlocking, the third body part 170 is also unlocked and moved, and the foldable toy 100 is transformed into a second shape having a spherical shape (e.g., see (e) in FIG. 5 and FIG. 6) from which it may be difficult or impossible to recognize the internal appearance and the first shape thereof before folding.

In other words, according to a comparative example, when the car shape is shown, the shape of a robot may be recognized, which is the shape after transformation. Similarly, when the shape of the robot is shown, the car shape may be recognized, which is the shape before transformation.

However, according to an embodiment of the present disclosure, from the spherical shape, which is the second shape that is folded, it may be difficult to infer the car shape that is the first shape before folding. Thus, it may be possible to use the foldable toy for various suitable games or play styles.

Second Embodiment

FIG. 7 is a perspective view illustrating a first shape of a foldable toy according to another embodiment of the present disclosure. FIG. 8 is a perspective view illustrating a second shape of the foldable toy according to the embodiment of FIG. 7. FIG. 9 is an exploded perspective view illustrating a configuration of the foldable toy according to the embodiment of FIG. 7. FIG. 10 is a perspective view illustrating a lower portion of the foldable toy according to the embodiment of FIG. 7. FIG. 11 is a perspective view illustrating an internal configuration in a partially disassembled state of the foldable toy according to the embodiment of FIG. 7. FIG. 12 is an example view illustrating an operation of the foldable toy according to the embodiment of FIG. 7. FIG. 13 is an example view illustrating an operation process of the foldable toy according to the embodiment of FIG. 7. FIG. 14 is an example side view illustrating a structure of a second shape of the foldable toy according to the embodiment of FIG. 7.

In FIGS. 7-14 the same reference numerals are used to designate the same or substantially the same components as those described above with reference to FIGS. 1-6, and thus, redundant description thereof may not be repeated.

As illustrated in FIGS. 7 to 14, a foldable toy 100' according to a second embodiment of the present disclosure includes a body part 110', a support part 110'*a* movably installed on the body part 110', a plurality of movable body parts rotatably installed on at least one of the body part 110' or the support part 110'*a*, and a locking part 150' installed on at least one of the movable body parts to be connected to (e.g., coupled with) the support part 110'*a* so as to support the movable body parts to maintain or substantially maintain a first position. When the locking part 150' is unlocked, the support part 110'*a* and the movable body parts move to a second position through a clockwise forward rotation and counterclockwise reverse rotation about the body part 110' relative to the orientation of the foldable toy 100' shown in the figures, so that the foldable toy 100' is folded into a second shape having a structure in which the body part 110', the support part 110'*a*, and the movable body parts are stacked on one another.

As another example, the foldable toy 100' includes a body part 110', a support part 110'*a*, a movable body part, a locking part 150', a latch part' 160', a third body part 170', and a transformation induction part 200. The moveable body part may include a first body part 120' and a second body part 140'

The first shape of the foldable toy 100' before folding may be configured in a shape of an airplane, a ship, a rocket, an animal, an insect, a character, a building, or an object, and may be equipped with moving means, for example, such as wheels and/or the like. The first shape may have various suitable shapes including the moving means capable of traveling on a floor (or the ground).

In addition, the second shape of the foldable toy 100' after folding may be configured as a partial shape, for example, such as a sphere, a disk, a cylinder, a polyhedron, a character shape, or a character's head, arm, leg, or trunk, and may also be configured in a shape in which the outside thereof is completely dosed or substantially closed, so as to hide the internal structure or appearance of the foldable toy 100' (e.g., to make the internal structure or appearance of the foldable toy 100' invisible or difficult to determine).

The body part 110' is a member constituting the base of the foldable toy 100', and rotatably supports the support part 110'*a* and the first body part 120'. At least a portion of the external surface of the body part 110' includes a curved surface (e.g., a spherical or semi-spherical surface having a curvature).

In addition, the body part 110' is rotatably connected to the first body part 120' via a body part first hinge 111' formed on a side (e.g., on one side) thereof, and includes a through hole 112' formed therein so as to allow a portion of a body part fixing lever 113' to pass therethrough.

The body part fixing lever 113' is rotatably installed on the body part 110' via a fixing lever hinge 114'. The body part fixing lever 113' includes a fixing lever coupling protrusion 115' provided on a side (e.g., on one side) thereof, and a fixing lever support part 116' provided on another side thereof.

When the fixing lever coupling protrusion 115' is engaged with the first body part 120', and the first body part 120' moves to the first position, the first body part 120' is fixed such that the first shape, which is the shape before folding, may be maintained or substantially maintained.

In addition, the fixing lever support part 116' supports the fixing lever coupling protrusion 115' to maintain or substantially maintain a state in which the fixing lever coupling protrusion 115' is engaged with the first body part 120'.

The support part 110'*a* is rotatably connected to another side the body part 110' via a body part second hinge 118'.

Body part third hinges 119 are formed on opposite sides of the body part 110', and wheels 117' are connected to (e.g., coupled to) the body part third hinges 119.

The support part 110'*a* is a plate-shaped member, and is connected to the body part second hinge 118' via the support part first hinge 111'*a*, so as to rotate about the body part 110' in a counterclockwise direction of the figures during the folding operation. A support part engagement protrusion 112'*a* is provided on another side of the support part 110'*a*.

The support part 110'*a* includes support part coupling protrusions 113'*a* on opposite side surfaces thereof, so that when the coupling protrusions 113'*a* are connected to (e.g., coupled with) portions of third body parts 170', the third body parts 170' are fixed to the opposite sides of the support part 110'*a*.

The support part 110'*a* presses against a floor using an elastic force of the spring 114', and the body part 110' is capable of maintaining or substantially maintaining a state of floating above the floor (e.g., a state of being spaced apart from the floor) while the support part 110'*a* rotates.

The first body part 120' is a member constituting a portion of the foldable toy 100', and is installed to be rotatable in a clockwise direction of the figures about the body part 110' during the folding operation. At least a portion of the external surface of the first body part 120 includes a curved surface (e.g., a spherical or semi-spherical surface having a curvature).

The first body part 120' is rotatably connected to the body part 110' via a first body part first hinge 121 formed on a side (e.g., on one side) thereof, and is rotatably connected to the second body part 140' via a first body part second hinge 122' formed on another side thereof.

In addition, the first body part 120' includes first body part third hinges 123' on opposite sides thereof to be connected to the third body parts 170', and the third body parts 170' are configured to be rotatable using an elastic force of a spring (not illustrated).

The first body part 120' may further include a support part fixing lever 124', a first body part coupling protrusion 126', and a through hole 127'.

The support part fixing lever 124' is a component that supports the first body part 120' and the second body part 140', such that the first body part 120' and the second body part 140' are capable of maintaining or substantially maintaining the first shape before folding. The support part fixing lever 124' includes a fixing lever coupling protrusion 125' on a side (e.g., on one side) thereof, and the fixing lever coupling protrusion 125' engages the second body part 140' so that the first body part 120' and the second body part 140' are capable of maintaining or substantially maintaining the first shape.

The through hole 127' allows the fixing lever coupling protrusion 115' provided on the body part 110' to be inserted therein, so that the first body part 120' is capable of maintaining or substantially maintaining the first shape before folding with the help of the fixing lever coupling protrusion 115'.

The first body part coupling protrusion 126' engages the second body part 140', such that the first body part 120' and the second body part 140' are capable of maintaining or substantially maintaining the first shape.

The second body part 140' is a member constituting a portion of the foldable toy 100'. The second body part 140' has a storage space formed therein, and the second body part fixing lever 130', the locking part 150', and the latch part 160' are installed in the storage space. A portion of the external surface of the second body part 140' is formed as a curved surface having a curvature.

In addition, the second body part 140' is sequentially installed on a side (e.g., on one side) of the first body part 120', and is configured to rotate in a clockwise direction of the figures, which is a top-down direction with respect to the body part 110', to be folded to the body part 110' during the folding operation.

The second body part 140' is connected to the first body part second hinge 122' via a second body part first hinge 141' provided on a side (e.g., on one side) thereof, and is configured to be rotatable using an elastic force of a spring (not illustrated).

The second body part 140' has a through hole 142' provided on a side (e.g., on one side) of the bottom surface thereof, such that a portion of the locking part 150' is exposed to the outside to engage the support part 110'*a*.

The second body part 140' includes a second body part coupling groove 143' at a side (e.g., at one side) thereof, which is connected to (e.g., coupled with) the fixing lever coupling protrusion 125'.

Wheels 117' may be installed on opposite sides of the second body part 140'.

The locking part 150' is installed inside the second body part 140' to be movable in a horizontal direction with respect to an orientation of the foldable toy 100' shown in the figures, and includes a locking part coupling protrusion 151' on a side (e.g., on one side) thereof. The locking part coupling protrusion 151' is engaged with the support part coupling protrusion 112'*a*, so as to maintain or substantially maintain the locked state in which the support part 110'*a* is fixed.

In addition, the locking part 150' includes locking part inclined surfaces 152' having a suitable angle (e.g., a predetermined angle) on opposite sides thereof.

The latch part 160' is installed on the locking part 150' to be movable in a vertical direction with respect to the orientation of the foldable toy 100' shown in the figures, and includes latch part inclined surfaces 162' having a suitable angle (e.g., a predetermined angle) on opposite sides thereof. The latch part inclined surfaces 162' are configured to be engaged with the locking part inclined surfaces 152', such that when the latch part 160' moves in the vertical direction, the locking part 150' is capable of moving in the horizontal direction.

The latch part 160' includes a magnet 163' so as to form a magnetic field with the transformation induction part 200, and the magnet 163' allows the latch part 160' to be moved in the vertical direction through the formed magnetic field.

When the magnetic field between the magnet 163' and the transformation induction part 200 is no longer formed or is removed (e.g., disappears) by installing a spring 164', the latch part 160' provides an elastic force such that the latch part 160' returns to its original position.

The third body parts 170' are members provided on the opposite sides of the first body part 120', respectively, so as to constitute a portion of the foldable toy 100', and at least a portion of the external surface of each of the third body parts 170' includes a curved surface (e.g., a spherical or semi-spherical surface having a curvature).

Each of the third body parts 170' is provided with a third body part hinge 171' on a side (e.g., on one side) thereof, so as to be connected to a corresponding first body part third hinge 123' via the third body hinge 171'. The third body parts 170' are configured to be rotatable in a direction perpendicular to or substantially perpendicular to the rotatable direction of the first body part 120' using an elastic force of a spring (not illustrated).

In other words, the third body parts 170' are configured to rotate in a forward rotation and a reverse rotation about the center of the body part 110' in a direction orthogonal to or substantially orthogonal to the rotatable direction (e.g., a rotational direction) of the first body part 120' and the second body part 140'.

The third body parts 170' include third body part coupling grooves 172', respectively, and the third body part coupling grooves 172' are connected to (e.g., coupled with) the support part coupling protrusions 113'*a*, thereby allowing the third body parts 170' to be fixed.

Hereinafter, an operation process of the foldable toy 100' according to the second embodiment of the present disclosure will be described.

First, the support part 110's is rotated about the body part 110' in a clockwise direction of the figures, and the first body part 120' and the second body part 140' are rotated in a counterclockwise direction of the figures, so as to be disposed at predetermined positions, respectively.

When the support part 110'*a*, the first body part 120', and the second body part 140' are disposed at the predetermined positions, the support part locking protrusion 112'*a* of the support part 110'*a* is engaged with the locking part 150', which is provided on the second body part 140', thereby being in the locked state.

In addition, when the body part 110', the first body part 120', and the second body part 140' are disposed at the positions in the first shape before folding, the body part fixing lever 113' of the body part 110' is connected to (e.g., coupled with) the first body part 120' through the through hole 127', so that the body part 110' and the first body part 120' are fixed.

The support part fixing lever 124' of the first body part 120' is connected to (e.g., coupled with) the second body pert 140' through the second body part coupling groove 143', so that the first body part 120' and the second body part 140' are fixed.

The second body part fixing lever 130' is engaged with the first body part coupling protrusion 126', so that the first body part 120' and the second body pert 140' are fixed.

When the third body parts 170' are engaged with and fixed to the support part coupling protrusions 113'*a* of the support pert 110*a*, the foldable toy is transformed into a car shape, which is the first shape before folding.

While in the first shape, the transformation induction part 200 is disposed at a position spaced apart from the foldable toy 100' by a suitable distance (e.g., a predetermined distance), and the foldable toy 100' is moved (or travels) toward the transformation induction part 200.

When the transformation induction part 200 and the magnet 163' of the foldable toy 100' react to each other to generate a magnetic field, the latch part 160' moves using the attractive force formed by the magnetic field, and the locking performed by the locking part 150' and the latch part 160' is released.

When the locking part 150' is unlocked, the support part 110'*a* is separated from the locking part 150', and the support part 110'*a* is moved in a counterclockwise direction of the figures, which is a bottom-up direction with respect to the body pert 110', about the body part 110' by the elastic force of the spring 114'*a*, thereby being folded to the body part 110'.

In this case, the first body part 120' and the second body pert 140' perform a folding operation with respect to the body part 110' in a floating state with the help of the support part 110'*a*.

When the locking part 150' is unlocked, the second body part 140' is rotated toward the first body part 120' about the second body part first hinge 141' using the elastic force of the spring (not illustrated). In this case, the support part fixing lever 124' and the second body part fixing lever 130' are separated from each other.

When the support part fixing lever 124' and the second body part fixing lever 130' are separated from each other, the first body part 120' is moved by the elastic force of a spring (not illustrated), such that the coupling with the body part fixing lever 113' is released. Consequently, the first body part 120' and the second body part 140' move in a clockwise direction of the figures, which is a top-down direction with respect to the body part 110', and is folded to the body part 110'.

In addition, when the support part 110'*a* is moved through the unlocking thereof, the third body parts 170' are also unlocked and moved, whereby the foldable toy 100' is transformed into a second shape having a spherical shape in which the internal appearance and the first shape of the foldable toy 100' before folding are hidden (e.g., are unknown).

Accordingly, the toy that has already been unfolded and maintains or substantially maintains the first shape is automatically folded into the second shape after folding. The second shape after folding may include various suitable shapes, for example, such as a disk, a cylinder, a sphere, a polyhedron, and/or the like, and it may be possible to use the toy in various suitable games or play styles.

Next, a foldable toy according to a third embodiment of the present disclosure will be described in more detail.

FIG. 15 is a side view illustrating a first shape of a foldable toy according to another embodiment of the present disclosure. A toy 100" according to a third embodiment includes a body part 110", a support part 110"*a*, a first body part 120", a second body part 140", a fastening part 180, and a fastening groove 182, and may be different from the toy according to the first embodiment n terms of the configuration of the fastening part 180 and the fastening groove 182.

In other words, the fastening part 180 is a member configured to connect (e.g., to couple) the toy 100" that is folded in the second shape with another foldable toy adjacent thereto, and is installed to be drawn out from the body part 110" or rotatably installed on the body part 110" via a fastening part rotation shaft 181.

The fastening groove 182 is provided on a side (e.g., on one side) of the body part 110", such that a fastening part of another toy folded into a second shape may be fixedly inserted into the fastening groove 182.

FIG. 16 is a perspective view illustrating a second shape of a foldable toy according to another embodiment of the present disclosure.

As illustrated in FIG. 16, the foldable toy may be configured as a toy 100*a*, which may be transformed into an arbitrary fist shape having, for example, a spherical shape, when the toy is transformed into the second shape shown in FIG. 16 after being folded from the arbitrary first shape.

The toy 100*a* may include a fastening part 180, which is rotatably installed to the folded body part of the toy 100*a* via a fastening part rotation shaft 181, so that when the toy 100*a* is transformed into the second shape, the fastening part 180 is drawn out from the body part.

In other words, the toy 100*a* may be configured to be a part of a larger toy having an entire shape of a third shape by being connected to (e.g., coupled to) other toys (e.g., other toy parts) after being folded into the second shape.

FIG. 17 is a perspective view illustrating a second shape of a foldable toy according to another embodiment of the present disclosure.

As illustrated in FIG. 17, the foldable toy may be configured as a toy 100*b* in which the shape of the second shape after being folded from an arbitrary first shape is transformed into an arm shape having a cylindrical shape. The toy 100*b* may include a fastening part 180 on a side (e.g., on one side) of the toy 100*b* that is rotatably installed via a fastening part rotation shaft 181 so as to be connected to (e.g., coupled with) another toy.

In addition, a fastening groove 182 may be provided on another side of the toy 110*b*, such that the fastening groove 182 is capable of being connected to (e.g., coupled with) a fastening part of another toy.

FIG. 18 is a perspective view illustrating a third shape of a foldable toy according to an embodiment of the present disclosure.

As illustrated in FIG. 18, the toy having the second shape after being folded and transformed from the arbitrary first shape may include various suitable shapes, for example, such as a fist-shaped toy 100*a*, an arm-shaped toy 100*b*, a head-shaped toy 100*c*, a trunk-shaped toy 100*d*, a leg-shaped toy 100*e*, and/or a foot-shaped toy 100*f*, and the toys transformed into the second shapes 100*a*, 100*b*, 100*c*, 100*d*, 100*e*, and 100*f* may be connected to (e.g., coupled to) each other via the corresponding fastening part so as to form the third shape having a robot shape.

Accordingly, when using the toys, it may be possible to provide a variety of suitable shapes, for example, such as a first shape that is a shape before folding, a second shape that is a shape after folding, and a third shape formed by connecting (e.g., by coupling) a plurality of toys after folding to one another.

In addition, by connecting (e.g., by coupling) the folded second shapes of the toys in various suitable ways, it may be possible to configure the third shape having a creative shape, thereby further enhancing the interest in play styles.

Because some of the above-described terms may be defined in consideration of the functions described in the present disclosure, and thus, may vary depending on the intention of a user or an operator or custom, the interpretation of these terms should be made based on the contents of the present disclosure.

Although some embodiments have been described, those skilled in the art will readily appreciate that various modifications are possible in the embodiments without departing from the spirit and scope of the present disclosure. Therefore, it is to be understood that the foregoing is illustrative of various example embodiments and is not to be construed as limited to the specific embodiments disclosed herein, and that various modifications to the disclosed embodiments, as well as other example embodiments, are intended to be included within the spirit and scope of the present disclosure as defined in the appended claims, and their equivalents.

DESCRIPTION OF REFERENCE SYMBOLS

100, 100', 100", 100*a*, 100*b*, 100*c*, 100*d*, 100*e*, 100*f*: toy
110, 110', 110": body part, 110*a*, 110'*a*, 110"*a*: support part
111, 111': body part first hinge, 111*a*: support part first hinge
112, 118': body part second hinge, 112': through hole
112*a*: support part second hinge, 112'*a*: support part engagement protrusion
113, 119': body part third hinge, 113': body part fixing lever
113*a*: support part coupling groove, 113'*a*: support part coupling protrusion
114': fixing lever hinge, 114*a*: support part coupling protrusion
115, 117': wheel, 115': fixing lever coupling protrusion
116: spring, 116': fixing lever protrusion
120, 120', 120": first body part, 120*a*: first auxiliary body part
121, 121': first body part first hinge, 121*a*: first auxiliary body part first hinge
122, 122': first body part second hinge, 122*a*: first auxiliary body part second hinge
123, 123': first body part third hinge, 124, 124*a*: spring
124': support part fixing lever, 125': fixing lever coupling protrusion
126': first body part coupling protrusion, 127': through hole
130: link part, 130': second body part fixing lever
131: link part hinge, 131': fixing lever coupling protrusion
132: link part first coupling protrusion, 132': fixing lever hinge
133: link part second coupling protrusion, 140, 140', 140": second body part
141, 141': second body part first hinge, 142: spring
142': through hole 143: second body part second hinge
143': second body part coupling groove, 150, 150': locking part
151, 151': locking part coupling protrusion, 152, 152': locking part inclined surface
160, 160': latch part, 161, 161': latch part coupling protrusion
162, 162': latch part inclined surface, 163, 163': magnet
164, 164': spring, 170, 170': third body part
171, 171': third body part hinge, 172, 172': third body part coupling groove
180: fastening part, 181: fastening part rotation shaft
182: fastening groove, 200: transformation induction part

The invention claimed is:

1. A foldable toy comprising:

a body part;

a support part movably coupled to the body part and configured to press against a floor using an elastic force of a spring such that the body part maintains a floating state above the floor when the support part rotates about the body part;

at least one movable body part movably coupled to at least one of the body part or the support part;

a locking part configured to fix the moveable body part in a first position to lock the foldable toy in a first shape in which the body part, the support part, and the movable body part are deployed; and a latch part movably coupled to the locking part and configured to move from the first position to a second position when the locking part reacts with a transformation induction part, to unlock the locking part, wherein, when the locking part is unlocked, the support part and the movable body part are configured to move to the second position wherein the support part and the moveable body part rotate about the body part through a clockwise forward rotation and a counterclockwise reverse rotation respectively, and the foldable toy is configured to be folded into a second shape in which the body part, the support part, and the movable body part are stacked on one another.

2. The foldable toy of claim 1, wherein the reaction comprises an attractive force applied to the latch part through a magnetic field or a physical contact with the transformation induction part.

3. The foldable toy of claim 2, wherein the movable body part comprises:

a first body part;

a second body part configured to rotate in a forward direction or a reverse direction about the body part; and a third body part configured to rotate about the body part in a direction orthogonal to a rotational direction of the first body part and the second body part.

4. The foldable toy of claim 3, wherein the first body part coupled to the body part, and configured to move in a top-down direction with respect to the body part, and wherein the second body part is coupled to the support part, and configured to move in a bottom-up direction with respect to the body part to be folded towards the body part.

5. The foldable toy of claim 3, wherein the first body part is coupled to the body part, and the second body part is coupled to a side of the first body part and configured to rotate in a top-down direction with respect to the body part to be folded towards the body part.

6. The foldable toy of claim 3, wherein the first shape before folding comprises a moving means.

7. The foldable toy of claim 3, wherein the second shape after folding is one of a disk, a cylinder, a sphere, or a polyhedron.

8. The foldable toy of claim 3, further comprising:

a fastening part configured to be drawn out from the body part or rotatable via a fastening part rotation shaft to be coupled to another foldable toy.

9. The foldable toy of claim 8, wherein the body part has a fastening groove to be coupled with a fastening part of the other foldable toy.

10. The foldable toy of claim 9, configured to be coupled to a plurality of foldable toys via the fastening part and the fastening groove to form a third shape along with the plurality of foldable toys.

* * * * *